US006405913B1

(12) United States Patent
Passamoni

(10) Patent No.: US 6,405,913 B1
(45) Date of Patent: Jun. 18, 2002

(54) PAPERBOARD DISPENSER CARTON WITH PLASTIC CUTTING BLADE

(75) Inventor: Phillip L. Passamoni, Green Bay, WI (US)

(73) Assignee: Green Bay Packaging, Inc., Green Bay, WI (US)

( * ) Notice: Subject to any disclaimer, the term of this patent is extended or adjusted under 35 U.S.C. 154(b) by 0 days.

(21) Appl. No.: 09/471,818

(22) Filed: Dec. 22, 1999

(51) Int. Cl.[7] ..... B26F 3/02; B65D 85/67
(52) U.S. Cl. ..... 225/43; 225/91; 225/49
(58) Field of Search ..... 225/91, 43, 20, 225/49, 89, 39, 48

(56) References Cited

U.S. PATENT DOCUMENTS

| | | | | | |
|---|---|---|---|---|---|
| 2,771,186 | A | | 11/1956 | Burbank | 206/58 |
| 3,088,640 | A | * | 5/1963 | Kunsch | 225/48 |
| 3,193,427 | A | | 7/1965 | Rogers | 156/211 |
| 3,516,587 | A | * | 6/1970 | Bjorklund | 225/48 X |
| 3,547,328 | A | | 12/1970 | Bjorklund | 225/49 |
| 3,567,087 | A | * | 3/1971 | Schramm | 225/43 |
| 3,722,767 | A | * | 3/1973 | Struble | 225/49 |
| 3,777,957 | A | * | 12/1973 | Buttery | 225/50 |
| 3,933,288 | A | * | 1/1976 | Struble | 225/49 X |
| 3,974,947 | A | * | 8/1976 | Budny | 225/49 X |
| 3,986,440 | A | * | 10/1976 | Macdonald et al. | 225/49 X |
| 4,346,830 | A | * | 8/1982 | Hauser | 225/49 |
| 4,399,935 | A | | 8/1983 | Nelder | 225/49 |
| 4,426,029 | A | * | 1/1984 | Kamp | 225/43 |
| 4,458,570 | A | * | 7/1984 | Morrison | 220/524 |
| 4,506,816 | A | * | 3/1985 | Roccaforte | 225/48 |
| 5,078,311 | A | * | 1/1992 | Taguchi et al. | 225/43 |
| 5,121,839 | A | * | 6/1992 | Lapp | 225/48 X |
| 5,190,199 | A | * | 3/1993 | Bulger et al. | 225/43 X |
| 5,226,571 | A | | 7/1993 | Eastwood et al. | 225/49 |
| 5,328,071 | A | * | 7/1994 | Aihara | 225/91 |
| 5,423,464 | A | * | 6/1995 | Yuki et al. | 225/43 |
| 6,173,876 | B1 | * | 1/2001 | Sano et al. | 225/39 |

OTHER PUBLICATIONS

"The Attacher" brochure, Ga–Vehren Engineering, 1993.
"Put Profit In The Bag" brochure, Ga–Vehren Engineering, 1997.

* cited by examiner

*Primary Examiner*—Boyer Ashley
(74) *Attorney, Agent, or Firm*—Boyle, Fredrickson, Newholm, Stein & Gratz, S.C.

(57) ABSTRACT

A paperboard carton for storing and dispensing a roll of web material, such as plastic film, foil, wax paper, etc. has a plastic (e.g. polystyrene) cutting blade that is adhered to an inside front lip of the paperboard carton lid. The polystyrene cutting blade preferably has a thickness of about 20/1000 of an inch, and preferably contains aggressive teeth at the ends of its serrated edge to help initiate tearing of the web material. The aggressive teeth are larger in size than the remaining teeth of the serrated edge. Use of the polystyrene cutting blade allows for increased production rates without compromising performance.

20 Claims, 4 Drawing Sheets

FIG. 5
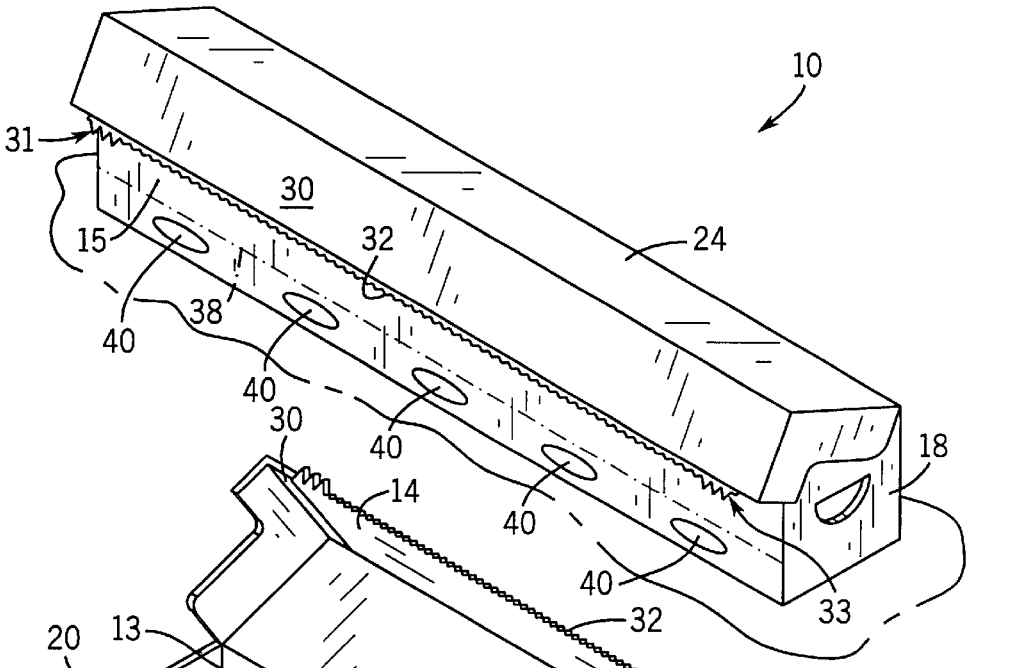
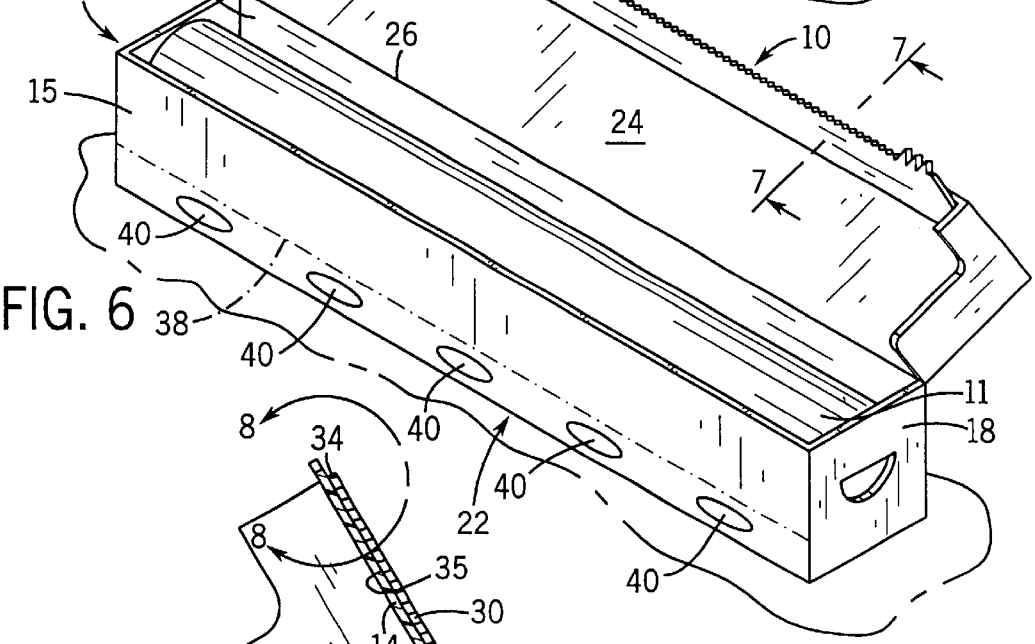
FIG. 6
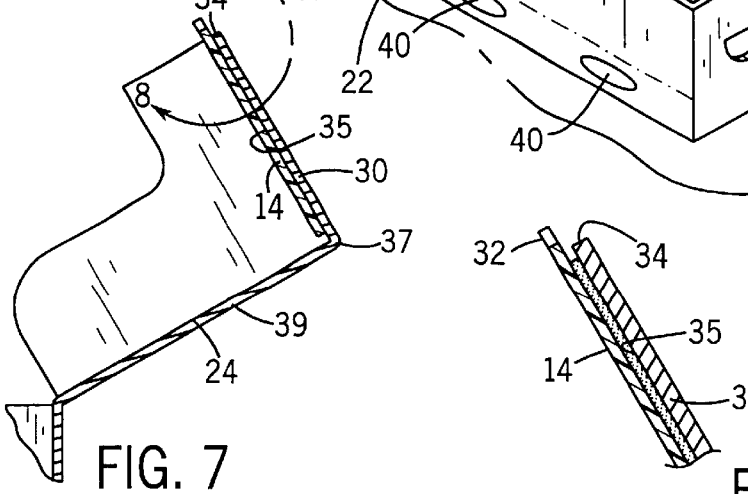
FIG. 7
FIG. 8

PAPERBOARD DISPENSER CARTON WITH PLASTIC CUTTING BLADE

FIELD OF THE INVENTION

The invention relates to the construction of paperboard cartons for dispensing rolls of plastic film, foil, wax paper, etc. More specifically, the invention relates to a paperboard carton having a plastic cutting blade (e.g. polystyrene), and a method of constructing the carton and attaching the plastic cutting blade to the carton.

BACKGROUND OF THE INVENTION

It is well known to dispense plastic films, wax paper, aluminum foil and other film materials from a paperboard carton. Normally, these paperboard cartons are formed from die-cut paperboard blanks which are glued and folded to form an elongated roll storage cavity. A lid is connected to the carton along a fold line between a back panel and the lid, such that the lid pivots about the fold line from an open position to a closed position. The lid normally has a front lip that nests adjacent a front panel of the carton when the carton is closed. Alternatively, the lid has a flap that folds inside the front panel to close the carton.

In most paperboard cartons, a serrated metal cutting blade is provided to cut the film or foil. The metal cutting blade is typically attached along the top edge of the front panel, although it is known in the art to attach the metal strip to the inside surface of the front lip. With either arrangement, the serrated edge is exposed in order to allow the user to tear the web along the serrated edge. It is known in the art to cover the serrated edges for shipment, perhaps using a removable cover strip over the serrated edge.

The serrated metal cutting blades are typically attached to the paperboard carton by stamping the serrated metal blade at a plurality of points onto the paperboard carton blank at the appropriate location. Such stamping techniques have been found much more reliable than adhesive, especially inasmuch as the width of the metal strips is typically about ⅜ of an inch and thus provides insufficient surface area for effective use of adhesive.

The present invention was developed in an attempt to increase production speeds above those now possible for paperboard cartons using metal cutting blades.

SUMMARY OF THE INVENTION

The invention is a paperboard carton that uses a plastic cutting blade mounted to the inside surface of the front lip of the lid. The plastic cutting blade is preferably approximately 20/1000 of an inch thick polystyrene which is die-cut to form teeth along one of its longitudinal edges. Each end of the polystyrene cutting blade preferably has aggressive teeth which are larger in size than the remaining teeth of the serrated edge to help initiate tearing of the web material.

One of the primary advantages of the invention is that the plastic cutting blade can be securely applied to paperboard carton blanks at a much faster production rate (e.g. approximately 150 units per minute) than the stamped metal cutting blades of the prior art. The plastic strip is preferably attached to the paperboard carton blanks using commercially available print finishing systems in which a feeding mechanism has been modified to accommodate feeding of the elongated plastic cutting blades. Hot melt adhesive is preferably used to secure the plastic cutting blade to the inside surface of the front lip of the lid. It has been found that the use of hot melt adhesive is particularly well suited for high production speeds. At reduced speeds, however, other means of adhering the plastic cutting blade to the paperboard carton blank (e.g. heat sealing, ultrasonic sealing, providing pressure-sensitive adhesive on the plastic cutting blade, etc.) may be suitable. In order to ensure adhesion of the plastic blade to the inside surface of the front lip of the carton as well as ensure the structural integrity of the plastic cutting blade, the width of the blade is preferably approximately one inch such that the plastic cutting blade substantially covers the entire inside surface of the front support lip on the carton lid. Another advantage of the invention is that the plastic cutting blades are somewhat safer to handle during the manufacturing processes, as well as by the end user.

In addition, the use of plastic cutting blades simplifies the recycling of paperboard cartons. Metal cutting blades complicate pulping procedures when the paperboard cartons are recycled in a batch along with other paper products. For example, it is normally necessary to remove metal cutting blades prior to or during the pulping process in order to protect recycling equipment. The use of plastic cutting blades eliminates this problem.

Another advantage of using a plastic cutting blade is that static is generated by the plastic cutting blade as the web is tom. This makes the film stick to the front of the carton, and it is therefore easier to grab the web for the next tear. Many prior art cartons used a small sticker to accomplish the same result.

Other advantages and objects of the invention may be apparent to those skilled in the art upon inspecting the following drawings and description thereof.

BRIEF DESCRIPTION OF THE DRAWINGS

1. Prior Art

2. Present Invention

FIG. 5 is a perspective view of a paperboard carton having a polystyrene cutting blade in accordance with the present invention.

FIG. 6 is perspective view of the paperboard dispenser carton shown in FIG. 5 in which the carton lid is opened in order to show the polystyrene cutting blade being attached to substantially the entire inside surface of the front lip of the lid in accordance with the invention.

FIG. 7 is a sectional view taken along lines 7—7 of FIG. 6.

FIG. 8 is a detailed view of the region in FIG. 7 designated by arrows 8—8 which shows the polystyrene cutting blade being attached to an inside surface of the front lip of the carton lid using an adhesive in accordance with the preferred embodiment of the invention.

Figure 9:
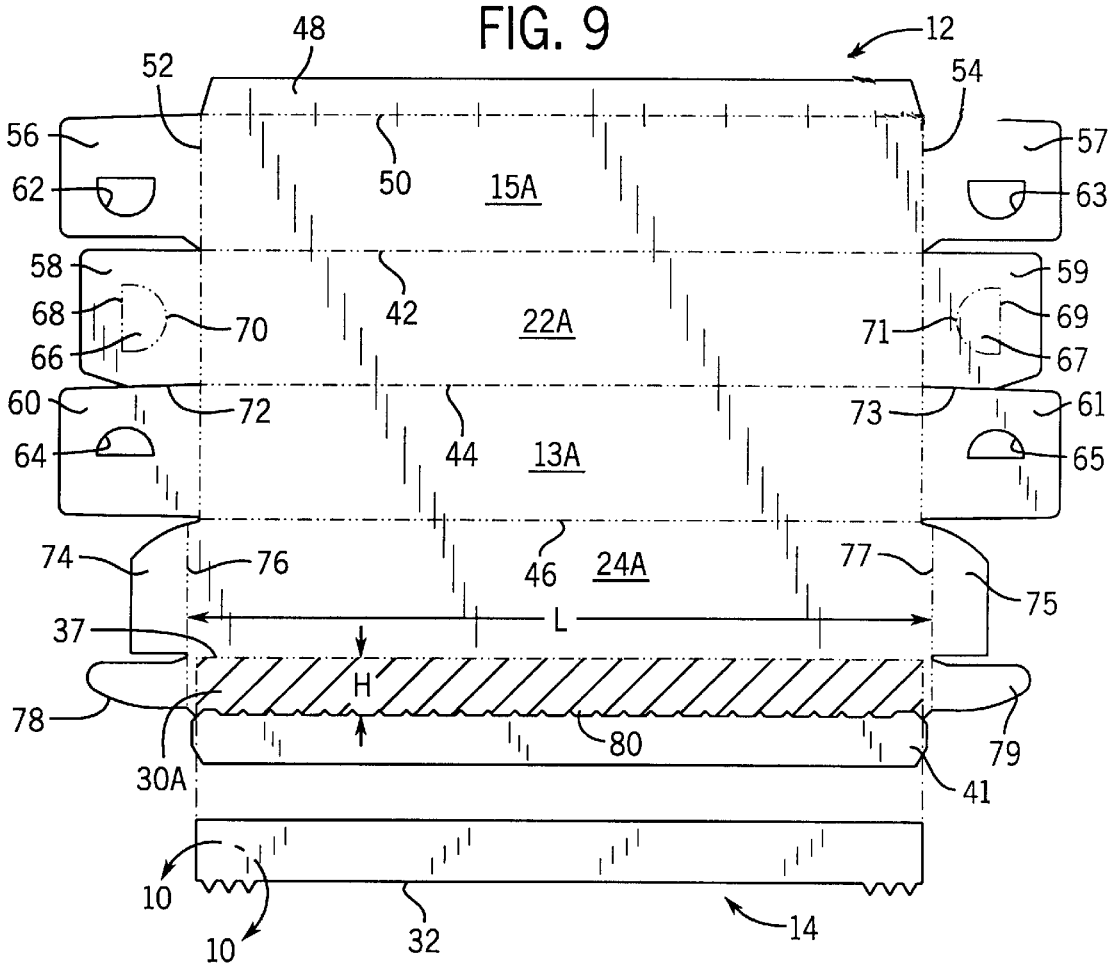

FIG. 9 is plan view of a paperboard carton blank which is die-cut and formed in order to manufacture the paperboard carton using a polystyrene cutting blade in accordance with a first version of the invention.

Figure 10:
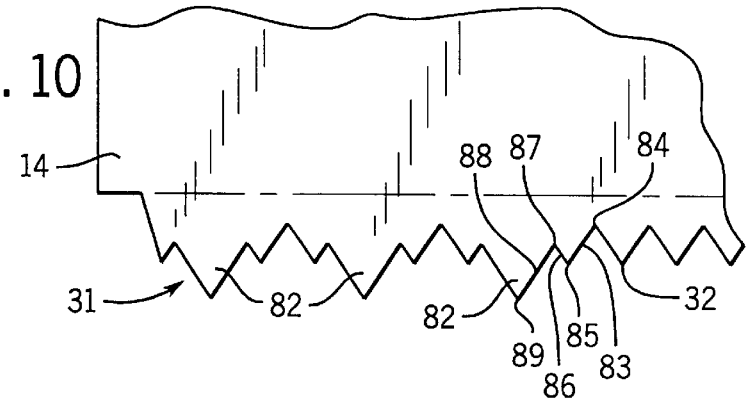

FIG. 10 is a detailed view illustrating an end portion of the serrated edge of the polystyrene cutting blade which illustrates the use of aggressive teeth in order to promote initiation of tearing of the roll stock.

Figure 11:
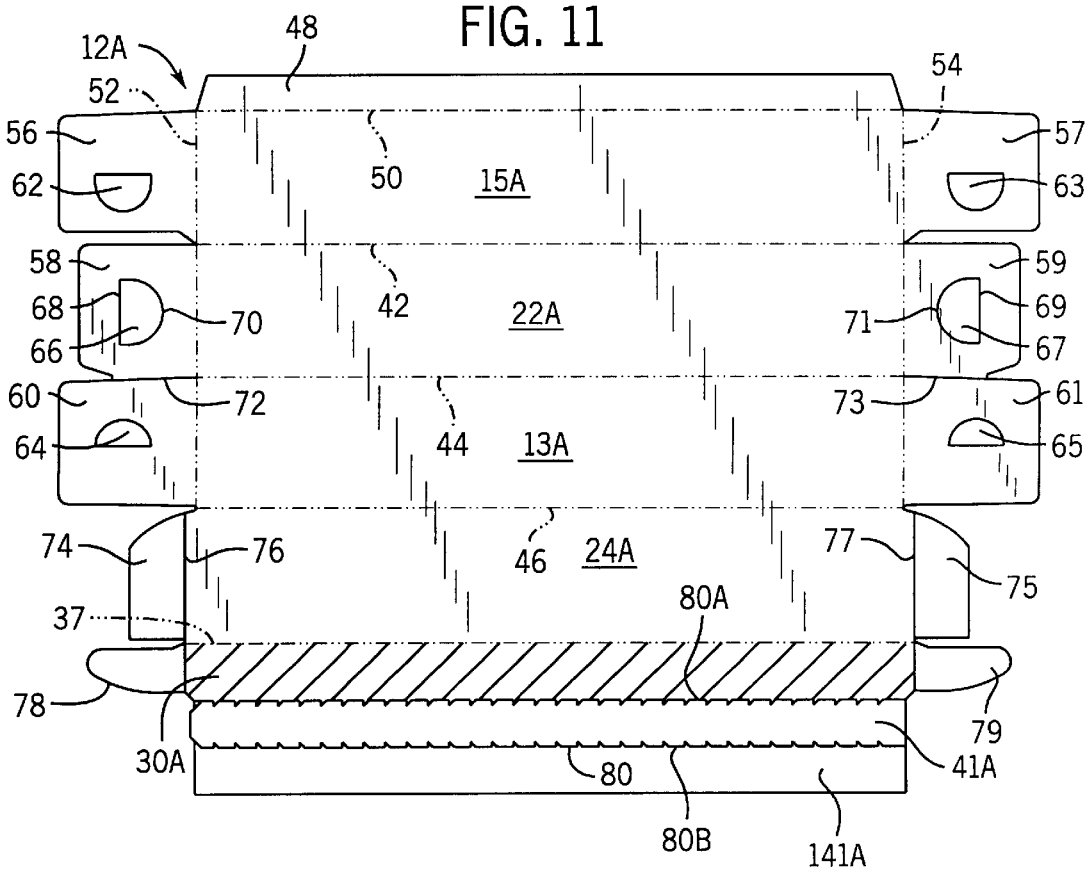

FIG. 11 is a plan view of a paperboard carton blank which is die-cut and formed in order to manufacture a paperboard carton using a polystyrene cutting blade in accordance with a second version of the invention.

Figure 12:
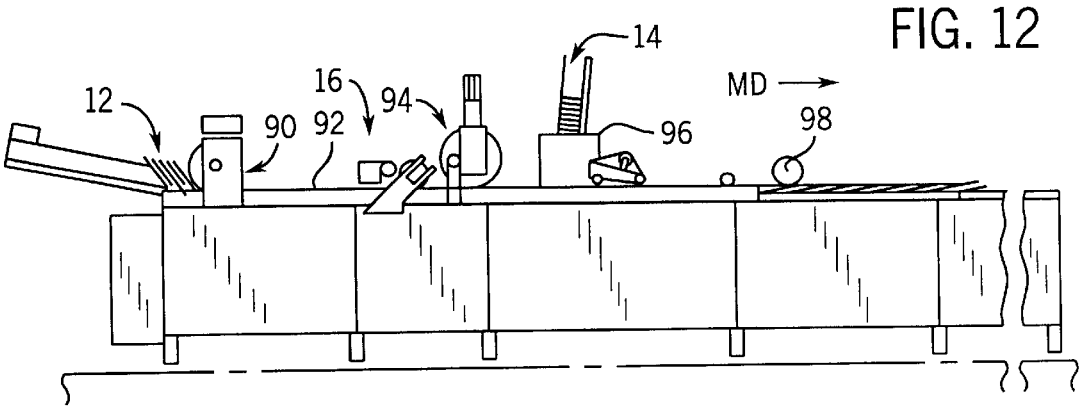

FIG. 12 is a schematic view of a finishing machine that applies adhesive to the paperboard carton blanks and adheres to the polystyrene cutting blades thereto.

DETAILED DESCRIPTION OF THE DRAWINGS

1. Prior Art

Figures 1, 2, 3, 4:
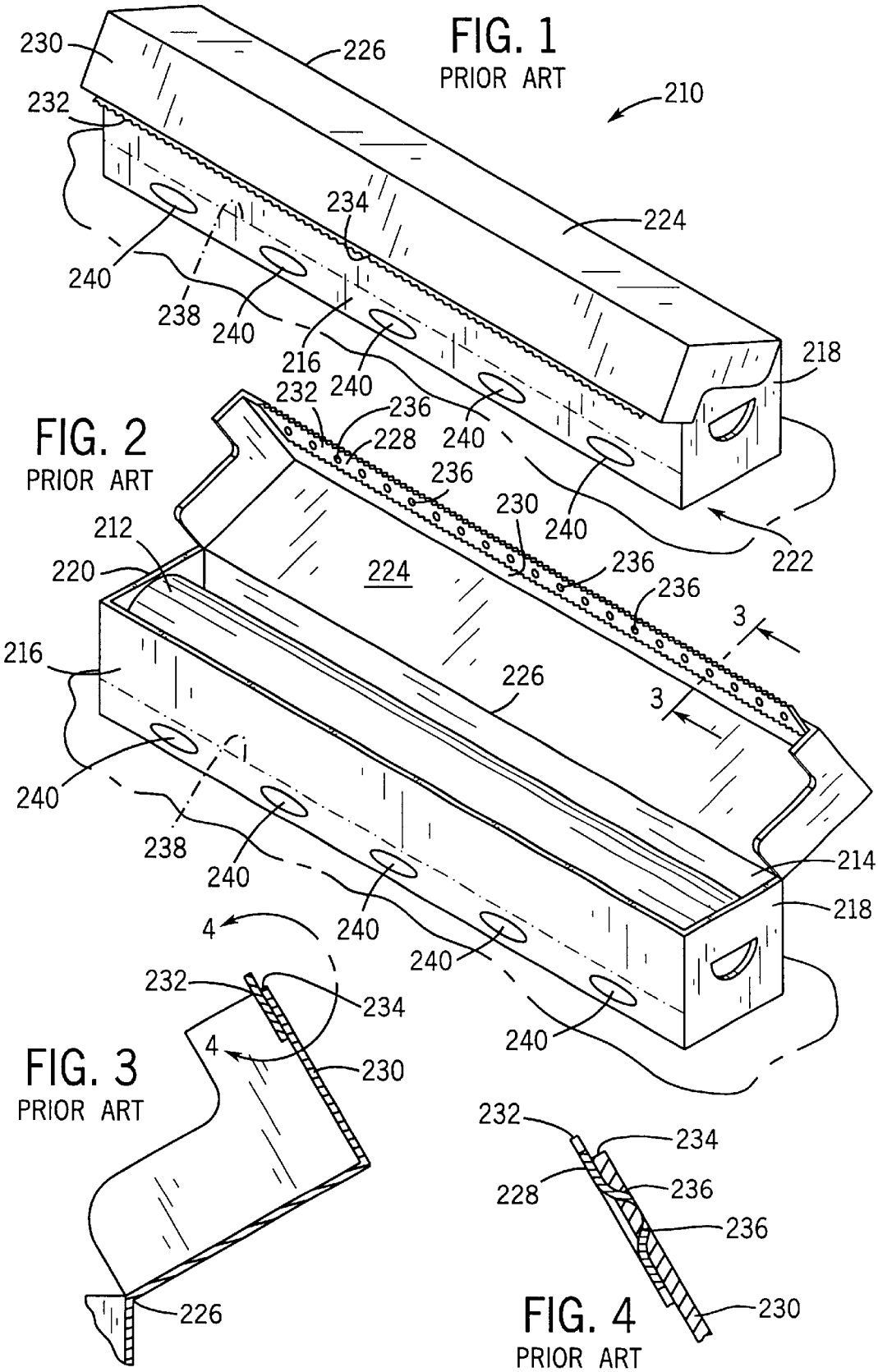
FIG. 1 PRIOR ART
FIG. 2 PRIOR ART
FIG. 3 PRIOR ART
FIG. 4 PRIOR ART
FIG. 1 is a perspective view of a paperboard dispenser carton having a metal cutting blade stamped thereto in accordance with the prior art.
FIG. 2 is another perspective view of prior art paperboard dispenser carton shown in FIG. 1 in which the carton lid is open in order to illustrate the metal cutting blade stamped to the inside surface of the front lip of the carton lid.
FIG. 3 is a sectional view taken along line 3—3 in FIG. 2.
FIG. 4 is a detailed view of the region on FIG. 3 designated by the arrows 4—4 which shows the details of the metal cutting blade being stamp-attached to the front lip of carton lid.

FIGS. 1 through 4 show a prior art paperboard carton 210 that stores and dispenses rolls 212 of plastic film, foil, wax paper, etc. The prior art paperboard carton 210 includes a back wall 214, a front wall 216, sidewalls 218, 220, and a bottom wall 222 which form a longitudinal cavity to store the roll 212. The prior art carton 210 also includes a lid 224 that is pivotally attached to an upper portion of the rear wall 214 along fold line 226. The lid 224 is able to pivot between an open position (FIG. 2) and a closed position. FIG. 1 shows the lid 224 in a position slightly opened from the closed position.

In accordance with the prior art, a metal cutting blade 228 is attached to a front lip 230 of the carton lid 224. The metal cutting blade 228 includes a serrated edge 232 having teeth having typically constant size. The serrated edge 232 of the metal cutting blade 228 extends generally along the entire longitudinal length of the front lip 230 of the carton lid 224, and is exposed slightly beyond the lower edge 234 of the front lip 230. The metal cutting blade 228 is attached along the inside top edge of the front panel lip 230 by stamping the metal cutting plate to the paperboard carton blank as is depicted by stamping indentions 236 shown in FIGS. 2 and 4. It is known in the art that this stamping technique fastens the metal cutting blade 228 to the front lip 230 in a secure manner which enables the metal cutting blade 228 to perform effectively over the course of the life of the paperboard carton 210.

When the paperboard carton 210 is in the closed position, the front lip 230 of carton lid 224 is generally parallel and nested against an outside surface of the front wall 216 of the carton 210. In the fully closed position, the serrated edge 232 of the metal cutting blade 228 is exposed adjacent the imaginary line depicted by reference numeral 238 on the outside surface of the front wall 216 of the carton 210. In order to dispense a panel of the roll material 212, the web 212 is unrolled and the carton lid 224 is placed in the closed position with the tail of the web extending beyond the exposed serrated edge 232 of the metal cutting blade 228. Then, beginning at one end of the exposed serrated edge 232 of the metal cutting blade, the user pulls the web along the length of the blade 228 to tear a panel of web material from the roll.

Prior to usage, a removable cover strip formed of paperboard (not shown) is attached along a perforation at the lower edge 234 of the front lip 230. Below the imaginary line 238 on the outside surface of the front wall 216 are located cut-scored targets for adhesive. The removable cover is attached with spots of adhesive to the lower portion of the outer surface of the front wall 216 at the cut-scored targets 240 in order to cover the serrated edge 232 during shipment. When the cover strip is removed to expose the serrated edge 232, the top layers of paper for the cut-scored targets are removed with the cover strip.

2. Present Invention

FIGS. 5 through 8 show a paperboard carton 10 constructed in accordance with the invention. FIGS. 9 and 10 illustrate a die-cut paperboard carton blank 12 and a polystyrene cutting blade 14 used to fabricate the paperboard carton 10. FIG. 11 illustrates another version of a die-cut paperboard carton blank 12*a*. FIG. 12 schematically illustrates a finishing machine 16 that attaches the polystyrene cutting blades 14 to the paperboard carton blanks 12 using hot melt adhesive.

A paperboard carton 10 constructed in accordance with the invention stores and dispenses rolls of plastic film, aluminum foil, wax paper, etc., and generally implements the same functions of the prior art paperboard carton 210 shown in FIGS. 1 through 4. The paperboard carton 10 includes a back walls a front wall 15, sidewalls 18, 20, and a bottom wall 22 which collectively form a longitudinal cavity to store the roll 11. The paperboard carton 10 also includes a lid 24 that is pivotally attached to an upper portion of the rear wall 13 along fold line 26. The lid 24 is able to pivot between an opened position (FIG. 6) and a closed position. FIG. 5 shows the lid 24 in a position slightly opened from the closed position.

In accordance with the invention, a plastic cutting blade 14, preferably a polystyrene cutting blade, is attached to a front lip 30 of the carton lid 24. The polystyrene cutting blade 14 includes a serrated edge 32 having teeth that have constant size except at the ends 31, 33. The ends 31, 33 of the serrated edge 32 of the polystyrene cutting blade 14 contain aggressive teeth having exaggerated size in order to promote the initiation of tearing the web material. The serrated edge 32 of the polystyrene cutting blade 14 extends generally along the entire longitudinal length of the front lip 30 of the carton lid 24, and is exposed slightly beyond the lower edge 34 of the front lip 30. The polystyrene cutting blade 14 is preferably attached along the inside surface 35 of the front panel lip 30 using permanent adhesive such as hot melt adhesive. As previously mentioned, various alternatives to hot melt adhesives such as heat sealing, ultrasonic sealing, pressure-sensitive adhesive with release liner, may be used to attach the polystyrene cutting blade 14 to the inside surface 35 of the front panel lip 30. The polystyrene cutting blade 14 preferably has a thickness of about $^{20}/_{1000}$ of an inch. In contrast to the metal cutting blades 228 of the prior art, the polystyrene cutting blade 14 preferably spans across substantially the entire inside surface 35 of the front lip 30 of the lid 24. This is desirable in order to ensure that the hot melt adhesive fastens the cutting blade 14 to the front lip 30 in a secure manner over the course of the entire life of the paperboard carton 10. In this regard, it is desirable that the polystyrene cutting blade 14 have a height sufficient to span from the edge 34 of the front lip 30 to the fold 37 between the top 39 of the lid 24 and front lip 30 of the lid 24. Normally, the height of the front lip 30 between the edge 34 and the fold line 37 is about 1 inch. It has been found that sizing the polystyrene cutting blade 14 such that it substantially covers the entire inside surface 35 of the front lip provides sufficient rigidity to the cutting blade 14 and the serrated edge 32, in order to optimize performance of the cutting blade 14.

When the paperboard carton 10 is in a closed position, the front lip 30 of the carton lid 24 is generally parallel and nested against an outside surface of the front wall 16 of the carton 10 in a manner similar to the prior art. In the fully closed position, the serrated edge 32 of the polystyrene cutting blade 14 is exposed adjacent the imaginary line depicted by reference numeral 38 on outside surface of the front wall 16 of the carton 10. In use, the roll 11 is unrolled so that a desired amount of web material extends beyond line 38. The user pulls the unrolled web material beginning at one of the ends 31, 33 of the serrated edge 32 against the polystyrene cutting blade 14 in order to tear a panel of web material from the roll 11.

When the carton 10 is in a closed position prior to usage, a removable cover strip 41 (FIG. 9) is attached along a perforation 80 at the lower edge 34 of the front lip 30. Below the imaginary line 38 on the outside surface of the front wall 16 are located cut-scored targets 40 for adhesive. The removable cover strip 41 is attached with adhesive to the lower portion of the outer surface of the front wall 16 at the cut-scored targets 40 in order to cover the serrated edge 34 during shipment. When the removable cover strip 41 is removed from the carton 10, the outer paper layer of the cut-scored targets 40 on the lower portion of the outer surface of the front wall 16 delaminates and is removed along with the removable cover strip 41.

Referring to FIG. 9, the paperboard carton blank 12 is die-cut into the form shown in FIG. 9, and includes several scored fold lines. The paperboard blank 12 is made of conventional paperboard having a smooth side and a rough side. The paperboard carton blank 12 has several elongated, rectangular portions 15*a*, 22*a*, 13*a*, 24*a*, 30*a*, and 41. Elongated, rectangular portion 15*a* corresponds to the front wall 15 of the carton 10. A fold line 42 separates the front wall portion 15*a* from elongated, rectangular portion 22*a* which corresponds to the bottom wall 22 of the carton 10. Fold line 44 separates the bottom wall portion 22*a* from elongated, rectangular portion 13*a* which corresponds to the back wall 13 of the carton 10. Fold line 46 separates the back wall portion 13*a* from elongated, rectangular portion 24*a* which corresponds to the top of the lid 24 on the carton 10. Fold line 37 separates the top lid portion 24*a* from the front lip portion 30*a*. The fold lines 42, 44, 46, and 37 are each parallel to one another.

The front wall reinforcement flap 48 is separated from the front wall portion 15*a* via fold line 50. Fold lines 52 and 54 are perpendicular to fold lines 42, 44, and 46. Fold line 52 separates front wall portion 15*a* from sidewall portion 56, bottom wall portion 22*a* from sidewall portion 58, and back wall portion 13*a* from sidewall portion 60. In a similar manner, fold line 54 separates front wall 15*a* from sidewall portion 57, bottom wall portion 22*a* from sidewall portion 59, and back wall portion 13 a from sidewall portion 61. A slit 72 is provided between sidewall portions 58, 60 and another slit 73 is provided between sidewall portions 59, 61. Sidewall portions 56, 57 adjacent the front wall portion 15*a* each have an ear access window 62, 63 die-cut therein. In a similar manner, sidewall portions 60, 61 adjacent back wall portion 13*a* have ear access windows 64, 65 die-cut therein. The sidewall portions 58, 59 adjacent bottom wall portion 22*a* have roll retaining ears 66, 67. The ears 66, 67 are formed by providing a fold line 68, 69 and semicircular slits 70, 71 in the respective sidewall portions 58, 59. The windows 62 and 64, and 63 and 65 for the roll retaining ears 66, 67 respectively are sized so that the ears 66, 67 can fold inward into the longitudinal cavity containing the roll 11 when a carton 10 is in use. When the paperboard carton blank 12 is folded into a carton 10, the sidewall portions 56, 57, 58, 59, 60, 61 are folded along the respective fold lines 52, 54, and overlap one another.

Lid sidewall portions 74, 75 are separated from the top lid portion 24*a* along fold lines 76, 77 respectively. Lid attachment flaps 78, 79 are separated from the front lip portion 30 of the lid also by fold lines 76, 77 respectively. As illustrated in FIG. 9, the polystyrene cutting blade 14 is attached to the front lip 30*a* (i.e. the cross-hatched portion). The polystyrene cutting blade 14 is preferably sized such that it covers substantially the entire inside surface of the front lip portion 30*a*. In other words, the preferred height of the polystyrene cutting blade 14 is substantially the same or slightly greater than the distance H between fold line 37 and perforation line 80. Also, the length of the polystyrene cutting blade 14 is only slightly less than the distance L between fold line 76, 77. As mentioned, this is the preferred configuration in order to ensure that the polystyrene cutting blade 14 is sufficiently rigid during use. Depending on paperboard strength and the required cutting forces, the height of the cutting blade may be reduced in certain applications. The attachment flaps 78, 79 are secured to the lid sidewall portions 74, 75 respectively with hot melt adhesive during the fabrication process in order that the front lip 30*a* and the polystyrene cutting blade 14 are fixed in a position substantially perpendicular to the top of the lid 24*a*.

The perforation line 80 separates the removable cover strip 41 from the front lip portion 30*a*. As mentioned previously, the cutting blade 14 is adhered to the blank 12 such that the serrated edge 32 extends slightly beyond the perforated line 80 so that the serrated edge 32 of the cutting blade 14 will exposed when the removable cover strip 41 is removed.

Referring to FIG. 10, the polystyrene cutting blades 14 can be die-cut from rectangular polystyrene blanks. The serrated edge 32 of the polystyrene cutting blades 14 includes a plurality of teeth, which along the central portion of blade 14 preferably have a constant size (e.g. approximately ⅙ of an inch from peak to valley). However, aggressive teeth 82 are located at the ends 31, 33 of the blade 14. The aggressive teeth 82 are substantially larger in size than the centrally located teeth. The preferred profile of the aggressive teeth 82 includes a first protruding section 83 extending between the base valley 84 and an intermediate peak 85, a receding section 86 extending between the intermediate peak 85 and an intermediate valley 87, and another protruding section 88 extending from the intermediate valley 87 to the ultimate peak 89. The aggressive teeth 82 are preferably symmetrical in nature. It has been found that this tooth geometry is particularly effective for initiating the tearing of plastic webs along the cutting blade 14, although other tooth geometries have been found to be effective as well. The drawings show a cutting blade 14 with three aggressive teeth 82 at each end 31, 33 of the blade, however, it has been found that five or more aggressive teeth 82 at each end 31, 33 may be desirable in order to ensure that the web catches the aggressive teeth 82 upon initiation of tearing of the web material.

FIG. 11 shows an alternative version of a paperboard carton blank 12*a*. In the paperboard carton blank 12*a*, the configuration of the removable cover strip 41*a* is different than the vision 12 shown in FIG. 10. More specifically, in FIG. 11, the paperboard carton blank 12*a* includes a longitudinal attachment strip 141*a*. When the carton 12*a* is in use, the longitudinal attachment strip 141*a* is permanently attached to the lower portion of the front wall of the carton. The longitudinal attachment strip 141*a* is attached to a lower portion of the outer surface of the front wall 15*a*, preferably with a continuous line of glue. In the version 12*a*, the removable cover strip 41*a* is defined between the first perforated longitudinal tear line 80*a* and the second perforated longitudinal tear line 80*b*. The removable cover strip 41*a* is not attached directly to the outer surface of the carton. One of the primary advantages of the version 12*a* shown in FIG. 11 over version 12 shown in FIGS. 5–10, is that glue can be applied to the back side of the longitudinal attachment strip 141*a* as a continuous line, rather than applying spots of glue only at targets 40 as in the earlier version 12, see FIGS. 5 and 6.

Referring to FIG. 12, the polystyrene cutting blades 14 can be attached to the paperboard carton blanks 12, 12*a* in an efficient manner using a finishing machine 16 as shown in FIG. 12. The machine 16 shown in FIG. 11 is a commercially available print finishing system in which the feeding mechanism has been modified to accommodate feeding of the elongated plastic cutting blades. The paperboard carton blanks 12, 12*a* are fed into the system by a vacuum feed wheel 90. The paperboard carton blanks 12 are then aligned in an alignment section 92 and fed to a gluer 94 which applies hot melt adhesive to the paperboard carton blanks in a specified pattern. The polystyrene cutting blades 14 are introduced into the system by a feeder 96 which places the blades 14 over hot melt adhesive in the appropriate location on the paperboard carton blank 12, 12*a*. A pressure cylinder 98 applies pressure to ensure that the cutting blades 14 are secured to paperboard carton blanks 12, 12*a*. The paperboard carton blanks 12, 12*a* with the adhesive applied thereto and the polystyrene cutting blades 14 applied thereto are then folded and formed downstream as is known in the art. The throughput of the finishing machine 16, is approximately 150 units per minute which is a substantial increase over the prior art systems.

Various alternatives and other embodiments are contemplated as being within the scope of the following claims which particularly point out and distinctly claim the subject matter regarded as the invention.

I claim:

1. A paperboard carton for storing and dispensing a roll of web material, the carton comprising:

a back wall, a bottom wall, a front wall and a first sidewall and second sidewall defining a roll storage container having a longitudinal roll storage cavity;

a longitudinal lid that is pivotally connected to a top edge of the back wall along a lid fold line, the longitudinal lid comprising a longitudinal top wall, a front longitudinal support lip and a removable cover strip, the longitudinal support lip being connected to the longitudinal top wall of the lid along a support lip fold line and securely attached to the lid so that the longitudinal support lip is directed substantially parallel with the front wall of the longitudinal roll storage cavity and located adjacent an upper portion of an outer surface of the front wall of the longitudinal roll storage cavity when the carton is closed, and the removable cover strip being connected to the longitudinal support lip along a perforated longitudinal tear line that is substantially parallel to the support lip fold line; and a longitudinal plastic cutting blade having a serrated edge, the plastic cutting blade being attached to an inside surface of the longitudinal support lip such that the serrated edge of the longitudinal cutting blade extends beyond the perforated longitudinal tear line, wherein the plastic cutting blade defines first and second spaced apart end areas and an intermediate area located therebetween, wherein the serrated edge of the plastic cutting blade includes a series of similarly configured first teeth extending throughout the intermediate area and occupying a majority of the length of the serrated edge, wherein the first teeth are arranged substantially linearly between the first and second end areas, and wherein the serrated edge further includes a first set of aggressive starting teeth located toward the first end area of the plastic cutting blade and a second set of aggressive starting teeth located toward the second end area of the plastic cutting blade, wherein the aggressive starting teeth are larger in size than the similarly configured first teeth and extend outwardly from the support lip a greater distance than the first teeth.

2. A paperboard carton as recited in claim 1 wherein an inside surface of the removable cover strip is removably adhered to a lower portion of the outer surface of the front wall of the roll storage container such that the removable cover strip conceals the serrated edge of the longitudinal plastic cutting blade before the removable cover strip is removed from the carton and the serrated edge of the longitudinal plastic cutting blade is exposed when the removable cover strip is removed from the carton.

3. A paperboard carton as recited in claim 1 wherein the plastic cutting blade is a polystyrene cutting blade that is die-cut from a sheet of polystyrene having a thickness of about $^{20}/_{1000}$ of an inch.

4. A paperboard carton as recited in claim 1 wherein the elongated plastic cutting blade is attached to the inside surface of the longitudinal support lip using hot melt adhesive.

5. A paperboard carton as recited in claim 1 wherein the plastic cutting blade contains five aggressive teeth at each end of the serrated edge.

6. A paperboard carton as recited in claim 1 wherein the perforated longitudinal tear line is a first perforated longitudinal tear line and the carton further comprises:

a longitudinal attachment strip that is attached to a lower portion of the outer surface of the front wall of the roll storage container; and a second perforated longitudinal tear line that is substantially parallel to the first perforated longitudinal tear line and separates the removable cover strip from the longitudinal attachment strip, the removable cover strip being defined between the first and second perforated longitudinal tear lines.

7. A paperboard carton as recited in claim 6 wherein glue is applied to a back side of the longitudinal attachment strip in a line to attach the longitudinal attachment strip to the front wall of the roll storage container.

8. The paperboard carton of claim 1, wherein each aggressive starting tooth has a profile including a base valley, a starting tooth peak located outwardly of the first teeth, and a intermediate peak and valley located between the base valley and the starting tooth peak.

9. The paperboard carton of claim 8, wherein an intermediate peak and valley are located on either side of each starting tooth peak.

10. The paperboard carton of claim 8, wherein each intermediate peak extends outwardly from the support lip a distance substantially equal to that of the first teeth.

11. A paperboard carton for storing and dispensing a roll of web material, the carton comprising:

a back wall, a bottom wall, a front wall and a first sidewall and second sidewall defining a roll storage container having a longitudinal roll storage cavity;

a longitudinal lid that is pivotally connected to a top edge of the back wall along a lid fold line, the longitudinal lid comprising a longitudinal top wall, a front longitudinal support lip and a removable cover strip, the longitudinal support lip being connected to the longitudinal top wall of the lid along a support lip fold line and securely attached to the lid so that the longitudinal support lip is directed substantially parallel with the front wall of the longitudinal roll storage cavity and located adjacent an upper portion of an outer surface of the front wall of the longitudinal roll storage cavity when the carton is closed, and the removable cover strip is being connected to the longitudinal support lip along a perforated longitudinal tear line that is substantially parallel to the support lip fold line; and a longitudinal plastic cutting blade having a serrated edge, the plastic cutting blade being attached to an inside surface of the longitudinal support lip such that the serrated edge of the longitudinal cutting blade extends beyond the perforated longitudinal tear line, wherein the plastic cutting blade extends substantially the entire distance of the longitudinal support lip between the top wall and the perforated longitudinal tear line and covers substantially the entire inside surface of the longitudinal support lip.

12. A paperboard carton for storing and dispensing a roll of web material, the carton comprising:

a back wall, a bottom wall, a front wall and a first sidewall and second sidewall defining a longitudinal roll storage cavity;

a longitudinal lid that is pivotally connected to a top edge of the back wall along a lid fold line, the longitudinal lid comprising a longitudinal top wall, a front longitudinal support lip, the longitudinal support lip being connected to the longitudinal top wall of the lid along a support lip fold line and securely to the lid so that the longitudinal support lip is directed substantially parallel with the front wall of the longitudinal roll storage cavity and located adjacent an upper portion of an outer surface of the front wall of the longitudinal roll storage cavity when the carton is closed; and a longitudinal plastic cutting blade having a serrated edge, the plastic cutting blade being attached to an inside surface of the longitudinal support lip via an adhesive, wherein the longitudinal plastic cutting blade extends substantially the entire distance of the inside surface of the longitudinal support lip between the top wall and the lid and a lower edge defined by the longitudinal support lip, wherein the plastic cutting blade is dimensioned so as to cover substantially the entire inside surface of the longitudinal support lip, and wherein the plastic cutting blade is configured such that the serrated edge of the cutting blade is exposed below the lower edge of the longitudinal support lip when the paperboard carton is in use in order to tear the web material.

13. A paperboard carton as recited in claim 12 wherein the adhesive comprises a hot melt adhesive.

14. A paperboard carton as recited in claim 12 wherein the plastic cutting blade is made of polystyrene.

15. A paperboard carton as recited in claim 14 wherein the polystyrene cutting blade is made by die-cutting a polystyrene sheet having a thickness of approximately $^{20}/_{1000}$ of an inch.

16. A paperboard carton for storing and dispensing a roll of web material, the carton comprising:

a back wall, a bottom wall, a front wall and a first sidewall and second sidewall defining a longitudinal roll storage cavity;

a longitudinal lid that is pivotally connected to a top edge of the back wall along a lid fold line, the longitudinal lid comprising a longitudinal top wall, a front longitudinal support lip, the longitudinal support lip being connected to the longitudinal top wall of the lid along a support lip fold line and securely to the lid so that the longitudinal support lip is directed substantially parallel with the front wall of the longitudinal roll storage cavity and located adjacent an upper portion of an outer surface of the front wall of the longitudinal roll storage cavity when the carton is closed; and a longitudinal plastic cutting blade having a serrated edge, the plastic cutting blade being attached to an inside surface of the longitudinal support lip via an adhesive such that the serrated edge of the cutting blade is exposed when the paperboard carton is in use in order to tear the web material;

wherein the serrated edge of the plastic cutting blade includes a series of similarly configured first teeth extending throughout a majority of the length of the serrated edge, and a set of aggressive starting teeth located toward at least one end of the serrated edge to help initiate tearing the web material, wherein the aggressive starting teeth are larger in size than the similarly configured first teeth of the serrated edge and extend outwardly from the support lip a greater distance than the first teeth, and wherein each aggressive starting tooth has a profile including a base valley, a starting tooth peak located outwardly of the first teeth, and an intermediate peak and valley located between the base valley and the starting tooth peak.

17. A paperboard carton as recited in claim 16 wherein the plastic cutting blade contains five aggressive teeth at each end of the serrated edge.

18. The paperboard carton of claim 16, wherein the plastic cutting blade defines first and second spaced apart end areas and an intermediate area located therebetween, wherein the first teeth occupy the intermediate area and are arranged substantially linearly between the first and second end areas, and wherein a first set of aggressive starting teeth are located at the first end area and a second set of aggressive starting teeth are located at the second end area.

19. The paperboard carton of claim 16, wherein an intermediate peak and valley are located on either side of each starting tooth peak.

20. The paperboard carton of claim 16, wherein each intermediate peak extends outwardly from the support lip a distance substantially equal to that of the first teeth.

* * * * *